US008844721B2

(12) United States Patent
Archambault et al.

(10) Patent No.: US 8,844,721 B2
(45) Date of Patent: Sep. 30, 2014

(54) STACKING CONFIGURATION FOR CONTAINER FOR FRANGIBLE ITEMS

(75) Inventors: Germain Archambault, Saint-Hubert (CA); François Blanchette, Mirabel (CA)

(73) Assignee: Pactiv Canada Inc., Scarborough, Ontario (CA)

( * ) Notice: Subject to any disclaimer, the term of this patent is extended or adjusted under 35 U.S.C. 154(b) by 0 days.

(21) Appl. No.: 12/637,108

(22) Filed: Dec. 14, 2009

(65) Prior Publication Data

US 2010/0147730 A1 Jun. 17, 2010

Related U.S. Application Data

(60) Provisional application No. 61/122,650, filed on Dec. 15, 2008.

(51) Int. Cl.
*B65D 85/32* (2006.01)

(52) U.S. Cl.
CPC ..... *B65D 85/32* (2013.01)
USPC ..... 206/521.1; 206/521.3; 206/521.6; 206/521.8

(58) Field of Classification Search
CPC ..... B65D 85/30; B65D 85/32; B65D 85/321; B65D 85/322; B65D 85/324; B65D 85/325; B65D 85/327; B65D 85/328
USPC ..... 206/521, 521.1, 521.15, 521.3, 521.6, 206/521.8
See application file for complete search history.

(56) References Cited

U.S. PATENT DOCUMENTS

| | | | | | |
|---|---|---|---|---|---|
| 1,967,040 | A | * | 7/1934 | Pickett | 217/26.5 |
| 2,100,516 | A | * | 11/1937 | Read | 206/521.8 |
| 2,600,130 | A | * | 6/1952 | Schilling | 206/521.8 |
| 2,655,303 | A | | 10/1953 | Cox | |
| 2,668,652 | A | * | 2/1954 | Russell | 206/521.1 |
| 2,843,304 | A | * | 7/1958 | Reifers | 206/521.1 |
| 3,337,110 | A | * | 8/1967 | Commisso et al. | 206/521.1 |
| 3,458,108 | A | * | 7/1969 | Snow et al. | 206/521.1 |
| 3,563,446 | A | * | 2/1971 | Lake et al. | 206/521.8 |
| 3,572,578 | A | | 3/1971 | Rohdin | |
| 3,613,987 | A | * | 10/1971 | Laidman | 206/521.1 |
| 3,645,436 | A | | 2/1972 | Boyd et al. | |
| 3,648,916 | A | * | 3/1972 | Commisso | 206/521.8 |
| D224,518 | S | * | 8/1972 | Pearl et al. | D9/757 |
| 3,687,350 | A | * | 8/1972 | Warburton | 206/521.1 |
| 3,687,355 | A | * | 8/1972 | Dahlberg | 206/521.1 |
| 3,712,532 | A | * | 1/1973 | Alroy | 206/521.1 |
| 3,813,027 | A | | 5/1974 | Misdom et al. | |
| 3,989,154 | A | * | 11/1976 | Walklet | 217/26.5 |

(Continued)

*Primary Examiner* — Anthony Stashick
*Assistant Examiner* — Ernesto Grano
(74) *Attorney, Agent, or Firm* — Baker Botts LLP

(57) ABSTRACT

A container for receiving frangible items comprises a sheet of polymer formed into a base portion having a plurality of item-receiving cavities for supporting frangible items. The item-receiving cavities have a frustoconical portion having a generally frustoconical geometry. A cover portion has an item-covering concavity for covering the frangible items. A first hinge is between a first longitudinal edge of the base portion and the cover portion for rotating the cover portion onto the base portion to hold the frangible items captive in the item receiving cavities. A hollow bridge spans between at least two adjacent item-receiving cavities of the container, a bottom edge of the hollow bridge being lower than a mid-height of the frustoconical portion of the item-receiving cavities.

20 Claims, 6 Drawing Sheets

(56) References Cited

U.S. PATENT DOCUMENTS

| | | | | |
|---|---|---|---|---|
| 4,553,692 | A | 11/1985 | Padovani | |
| 4,603,809 | A * | 8/1986 | Vilotte et al. | 206/521.2 |
| 5,494,164 | A | 2/1996 | Ramirez | |
| 6,012,583 | A | 1/2000 | Ramirez | |
| D466,802 | S | 12/2002 | Davkovski | |
| 7,255,231 | B2 * | 8/2007 | Andrews et al. | 206/521.1 |
| 7,258,234 | B2 | 8/2007 | Aardema et al. | |
| 7,353,951 | B2 * | 4/2008 | Vovan | 206/521.8 |
| 2005/0178689 | A1 * | 8/2005 | Aardema et al. | 206/521 |
| 2005/0189256 | A1 | 9/2005 | St-Onge | |
| 2006/0060493 | A1 * | 3/2006 | Marshall | 206/521.1 |
| 2007/0151892 | A1 * | 7/2007 | St-Onge | 206/521.1 |

* cited by examiner

STACKING CONFIGURATION FOR CONTAINER FOR FRANGIBLE ITEMS

CROSS-REFERENCE TO RELATED APPLICATION

The present application claims priority on U.S. Provisional Patent Application No. 61/122,650, filed on Dec. 15, 2008, and incorporated herein by reference.

FIELD OF THE APPLICATION

The present application relates to containers for receiving frangible objects such as eggs, and to structural components of such containers for allowing the stacking of such containers.

BACKGROUND OF THE ART

Egg containers of all kinds have been developed for the transportation and sale of eggs. As eggs are relatively fragile, the egg containers must protect the eggs from the various manipulations involved from the packaging of the eggs to the consumer's refrigerator.

One significant improvement in egg containers is the use of thermoformed plastics as material for the egg containers. Thermoformed plastics are typically transparent, which allows the eggs to be visible, and are relatively inexpensive to produce. As they can inspect the eggs by seeing through the material of the egg container, the consumers do not need to open the egg container, as is the case with cardboard egg containers, for instance. In the case of cardboard boxes, it may occur that the boxes are not closed properly after inspection. This may cause the breakage of eggs if the improperly closed egg container is subsequently manipulated by another consumer.

One of the issues with containers of thermoformed plastics pertains to the flexibility of the plastic. Thermoformed plastics are thin, whereby the containers may not be perfectly flat if laid, for instance, on a non-flat surface (e.g., a pallet). Accordingly, stacks of thermoformed plastic containers may have a tendency to lean in one direction. Additional packaging and/or special care may thus be required in transporting filled containers.

SUMMARY OF THE APPLICATION

It is therefore an aim of the present disclosure to provide a container for frangible items that addresses issues associated with the prior art.

Therefore, in accordance with the present application, there is provided a container for receiving frangible items comprising a sheet of polymer formed into: a base portion having a plurality of item-receiving cavities for supporting frangible items, the item-receiving cavities having a frustoconical portion having a generally frustoconical geometry; at least one cover portion having at least one item-covering concavity for covering the frangible items; a first hinge between a first longitudinal edge of the base portion and the cover portion for rotating the cover portion onto the base portion to hold the frangible items captive in the item receiving cavities; and a hollow bridge spanning between at least two adjacent item-receiving cavities of the container, a bottom edge of the hollow bridge being lower than a midheight of the frustoconical portion of the item-receiving cavities.

Further in accordance with the present application, there is provided a container for receiving frangible items comprising a sheet of polymer formed into: a base portion having a plurality of item-receiving cavities for supporting frangible items, the item-receiving cavities each having a generally frustoconical shape flaring upwardly; at least one cover portion having at least one item-covering concavity for covering the frangible items; a first hinge between a first longitudinal edge of the base portion and the cover portion for rotating the cover portion onto the base portion to hold the frangible items captive in the item-receiving cavities; and a projection with an abutment surface in at least one of the item-receiving cavities, the abutment surface being on a side of the item-receiving cavities facing outwardly from the container, the abutment surface extending upward from a bottom of the item-receiving cavities and facing outward of the container, the abutment surface being perpendicular to a ground when the container is laid on the ground, and the abutment surface being parallel to the first longitudinal edge of the container.

Still further in accordance with the present application, there is provided a container for receiving frangible items comprising a sheet of polymer formed into: a base portion having a main top wall lying in a single plane, a plurality of item-receiving cavities projecting downwardly from the main top wall for supporting frangible items, the item-receiving cavities having a frustoconical portion having a generally frustoconical geometry, each item-receiving cavity being separated from at least one other said item-receiving cavity by the main top wall, each item-receiving cavity merging into the main top wall by an arcuate edge from a top plan view, the arcuate edge covering at least a quarter of a periphery of each said item-receiving cavity; at least one cover portion having at least one item-covering concavity for covering the frangible items; and a first hinge between a first longitudinal edge of the base portion and the cover portion for rotating the cover portion onto the base portion to hold the frangible items captive in the item-receiving cavities.

DESCRIPTION OF THE PREFERRED EMBODIMENTS

Figure 1:
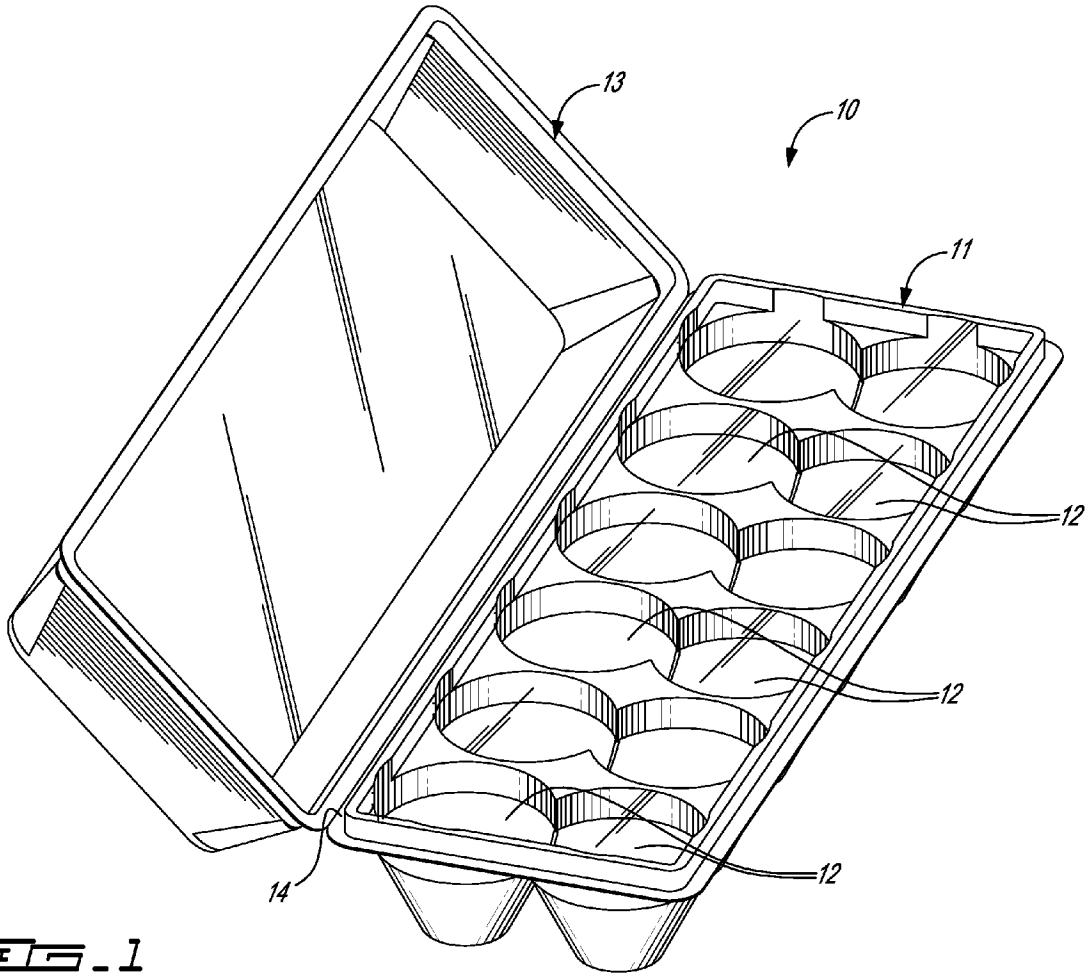
FIG. 1 is a schematic perspective view of a two-fold egg container.

Referring to the drawings and more particularly to FIG. 1, an egg container is generally shown at 10. The egg containers described hereinafter are preferably made of transparent or translucent plastics, for instance using a thermoforming process or other molding process. In one embodiment, the egg containers are formed from a single, flat sheet of plastic. Other materials and/or processes may be used as well. The containers described hereinafter may be used to contain eggs or any other frangible items (e.g., tomatoes), in any suitable number (e.g., 6, 12, 18, 24).

The egg container 10 of FIG. 1 is a two-fold egg container, as it has two portions hinged to one another. The egg container 10 has a base portion 11 having a plurality of egg-receiving cavities 12 (e.g., six, twelve, eighteen, twenty-four, or any other suitable number), with each cavity 12 supporting an egg. A top cover portion 13 is hinged to the base portion 11 by hinge 14, in a longitudinal dimension of the egg container 10. The top cover portion 13 may or may not have egg cavities to cover a top portion of the eggs supported by the egg-receiving cavities 12. Alternatively, the top cover portion 13 may present a flat top surface as in FIG. 1, with or without strengthening components (e.g., arches, posts). Although not shown, mating connectors or any other suitable type of connectors are provided on the periphery of the base portion 11 and top cover portion 13 for interlocking them when the egg container 10 is closed.

Figure 2:
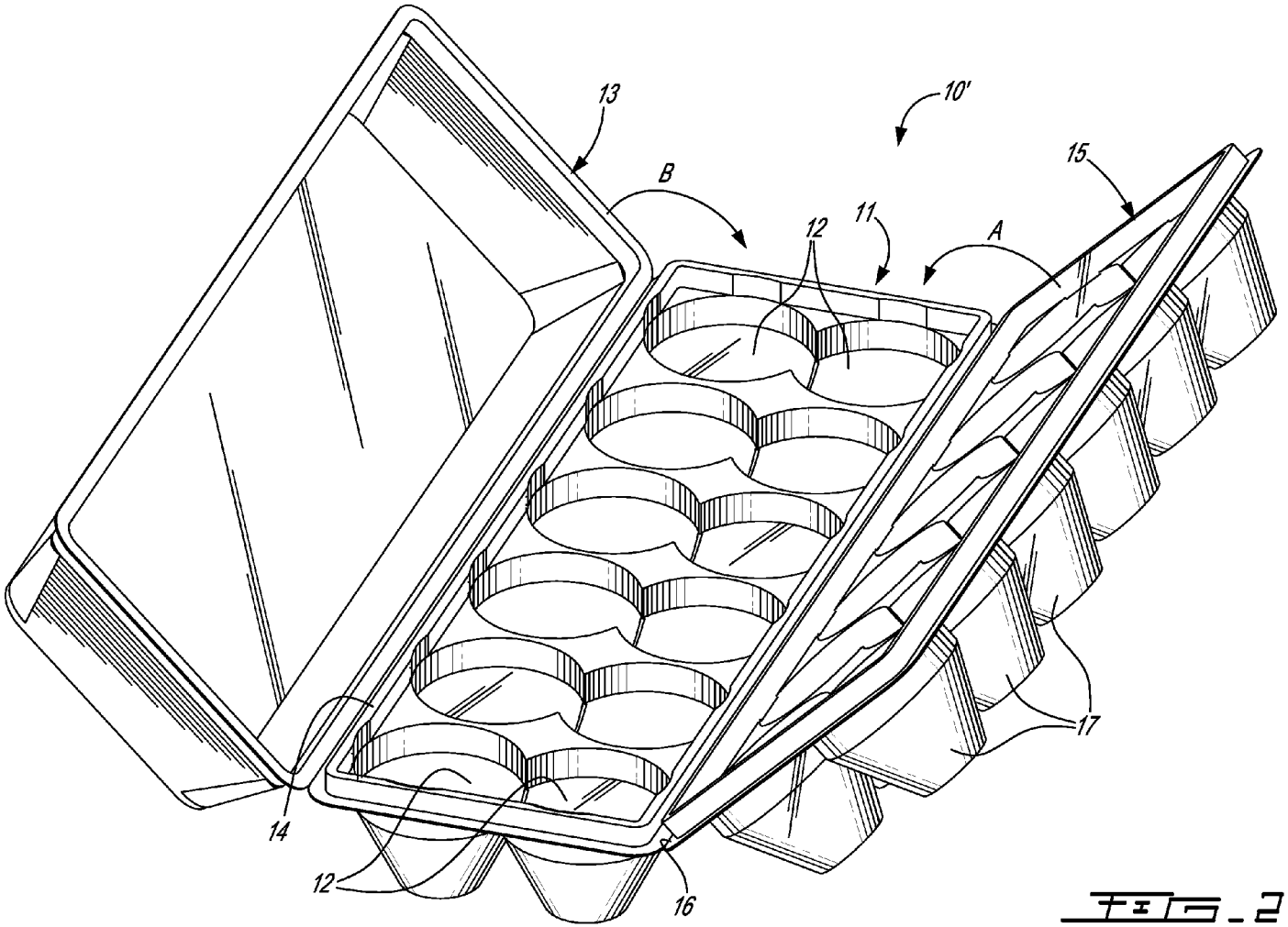
FIG. 2 is a schematic perspective view of a three-fold egg container.

Referring to FIG. 2, a three-fold egg container is generally illustrated at 10'. The egg container 10' is similar to the egg container 10 of FIG. 1, but has an intermediate cover portion 15. The intermediate cover portion 15 is hinged to the base portion 11 by hinge 16, in a longitudinal dimension of the egg container 10'. The hinges 14 and 16 are preferably on opposite edges of the base portion 11. The intermediate cover portion 15 typically has egg cavities 17 to cover a top portion of the eggs supported by the egg-receiving cavities 12. Although not shown, mating connectors or any other suitable type of connector are provided on the periphery of the top cover portion 13 and the intermediate cover portion 15 for interlocking them when the egg container 10' is closed.

In order to close the egg container 10', the intermediate cover portion 15 is firstly hinged into contact with the base portion 11, as illustrated by arrow A. The top cover portion 13 is then hinged onto the intermediate cover portion 15, as illustrated by arrow B.

The egg containers of the present disclosure may contain any suitable number of item-receiving cavities. One suitable material for the egg containers of the present application is polyethylene terephthalate (PET). PET has many advantages, as this material can be transparent or opaque and can be produced at high volume and at low cost. Wall thicknesses of PET cases in a contemplated embodiment are of 0.0175 inch in thickness, but other thicknesses as low as 0.012 to as high as 0.022 inch are also contemplated, but this thickness may vary, for instance, once the sheet is formed into the egg container 10/10'.

At this thickness, PET containers are structurally weak and are deformable. For instance, a longitudinal axis of a PET container may be bent/curved substantially. The deformation typically occurs at the web of material between adjacent cavities 12.

The afore-described containers 10/10' may lack desired strength that allows the top panel to remain substantially in place (i.e., horizontal) during the filling process. One remedy is to produce cases of smaller overall dimensions, for example, boxes containing 12 eggs instead of two dozen. However, the sale of 24 eggs in a single package is often desirable in the marketplace.

Thus, several reinforcement means are present in the containers 10/10' to rigidify the PET structure and allow the base portion 11 to accommodate a greater number of elements within the receiving cavities 12.

Figure 3:
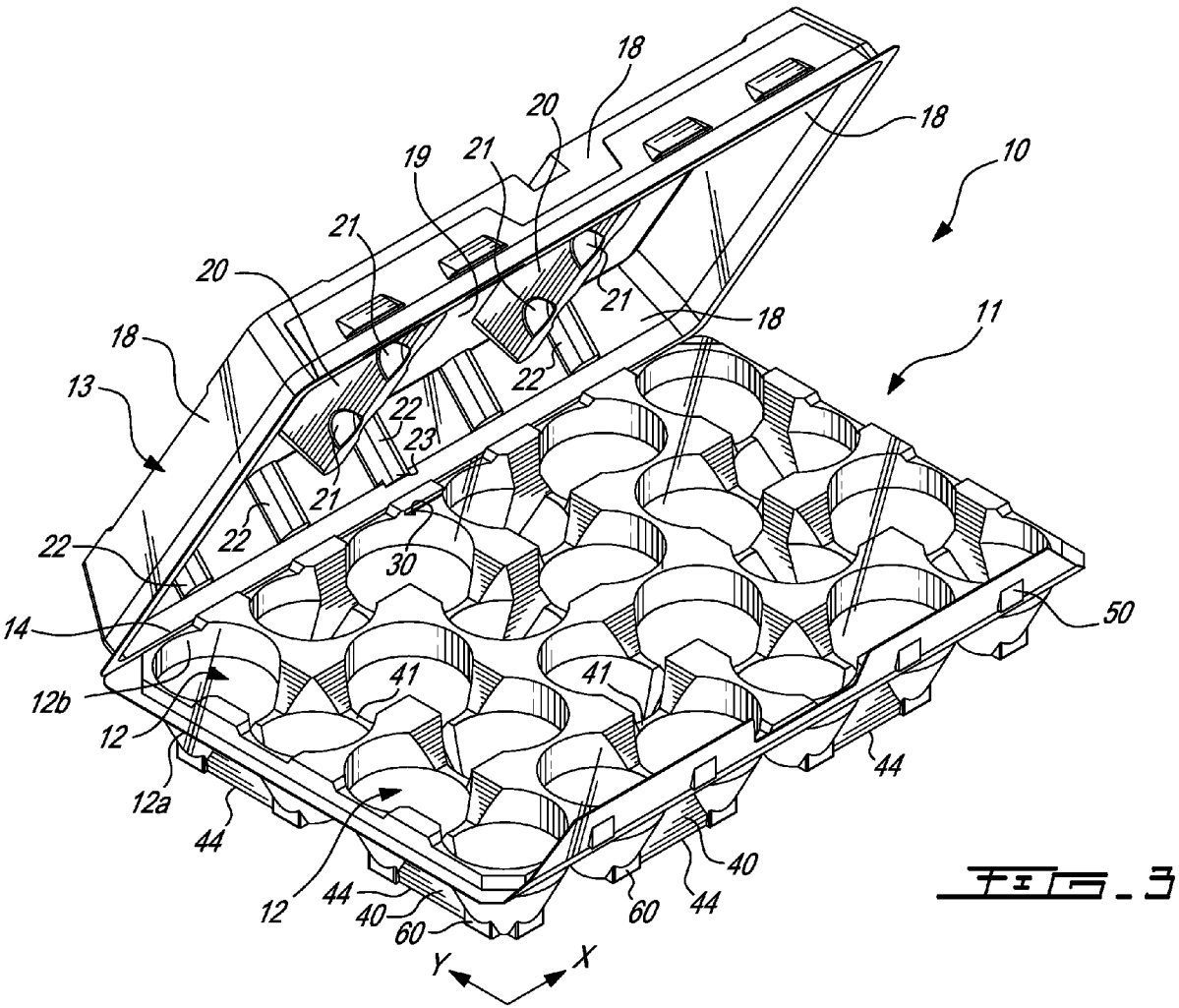
FIG. 3 is a perspective view of an egg container in accordance with embodiments of the present disclosure, as opened.

In one embodiment, referring to FIG. 3, the top cover portion 13 has one large concavity having peripheral walls 18 and a main flat top wall 19 into which center reinforcement beams 20 are formed to rigidify the center of the top cover portion 13. The center reinforcement beams 20 may be as described in US Patent Application publication no. US 2007/0151892, incorporated herein by reference. The top cover portion 13 has two of the center reinforcement beams 20, with the beams 20 projecting inwardly from the top wall 19. Exteriorly projecting clearances 21 may be formed into the beams 20, so as not to come into contact with items (e.g., eggs) received in the cavities 12, as the center reinforcement beams 20 sit on the top surface of the base portion 11 when the container 10 is closed, as detailed hereinafter. Struts 22 may be provided as well in one or more of the peripheral walls 18, to strengthen the peripheral walls 18.

One or more of the columns 22, i.e., the central column in FIG. 3, may have a male connector end 23. The male connector end 23 is matingly received in a female connector 30 in the base portion 11. Alternatively, the male connector end 23 may alternatively be in the base portion 11 while the female connector 30 is in the cover portion 13. Moreover, although being adjacent to one of the peripheral walls 18, the mating connectors may be provided elsewhere. The presence of mating connectors between the base portion 11 and the cover portion 13 reduces the possibility of a "shearing" movement of the cover portion 13 with respect to the base portion 11, and also reduces the risk of collapse of the adjacent peripheral wall 18.

Figure 4:
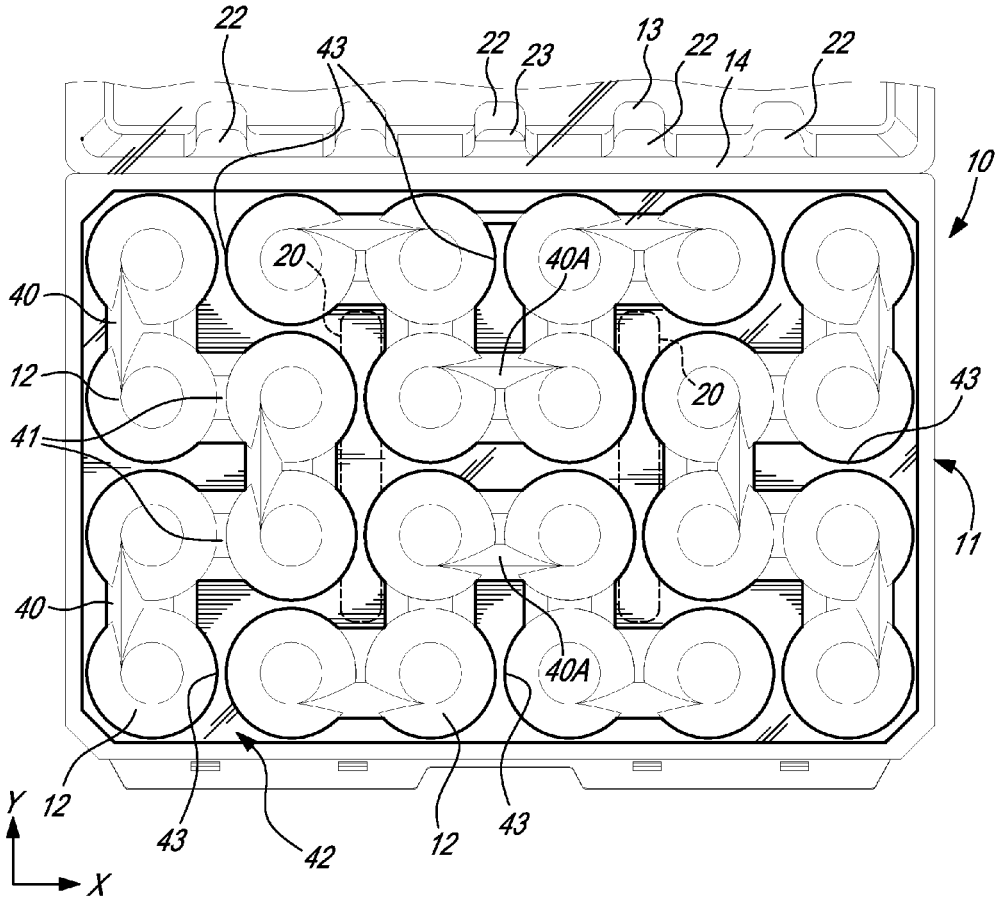
FIG. 4 is a top plan view of a base portion of the egg container in accordance with embodiments of the present disclosure.

In the embodiment shown concurrently in FIGS. 3 and 4, 24 receiving cavities 12 are arranged in four rows of six cavities each. Each receptacle may include a curved bottom and strengthening ridges, as known in the art. The egg container 10, or alternatively 10', has intermediate bridges 40 between some adjacent cavities 12. The bridges 40 are preferably hollow, as shown in FIGS. 3 and 4. The bridges 40 increase the overall rigidity of the base portion 11 against flexion along axes X and Y, thereby increasing the rigidity of the egg container 10/10' in a horizontal plane. Moreover, in an embodiment, there is at least one bridge 40 between each row of cavities 12, and between each column of cavities 12.

In the embodiment of FIGS. 3 and 4, each egg-receiving cavity 12 is connected to one other egg-receiving cavity 12 by one of the bridges 40. Any single egg-receiving cavity 12 may be connected to more than one other egg-receiving cavity 12 by one of the bridges 40.

There may also be shoulders 41 between adjacent egg-receiving cavities 12. The shoulders 41 also increase the rigidity between adjacent cavities 12, but do not extend as low and therefore do not thin the plastic as much as the bridges 40 do. The egg-receiving cavities 12, bridges 40 and shoulders 41 all project downwardly from a structural wall 42. The structural wall 42 has an upwardly oriented substantially planar surface (lying in a single plane). The planar surface therefore has a network of branches defined by the periphery of the egg-receiving cavities 12, bridges 40 and shoulders 41. As seen in the embodiment of FIG. 4, all branches of the planar surface are interconnected, whereby the planar surface is not segmented. By the planar surface not being segmented, the structural wall 42 has no edges other than that defined by the periphery of the egg-receiving cavities 12, bridges 40 and shoulders 41. The non-segmented planar surface enhances the structural integrity of the egg container.

Moreover, in the planar surface of the structural wall 42, branches 43 passing between adjacent egg-receiving cavities 12 may have arcuate shapes, as illustrated in FIGS. 3 and 4. The arcuate shapes of the branches 43 represent for each cavity 12 at least one quarter of the periphery, and thus more evenly distribute any pressure exerted against the structural wall 42.

Referring to FIG. 3, the geometry of the egg-receiving cavities 12 typically comprises a frustoconical portion **12*a* at a bottom of the egg-receiving cavity 12, and a semicylindrical portion 12*b* interfacing the frustoconical portion 12*a* to a structural wall 42. Other geometries can be used as alternatives to the frustoconical portion 12***a* and the semicylindrical portion 12*b*. Also, although not shown, the frustoconical portion 12*a* and the semicylindrical portion 12*b* may have ribs or channels to support eggs with a reduced surface of contact. As shown in FIG. 3, the bridges 40 may have a bottom edge 44 planar with a bottom of the frusto-conical portion 12*a*. However, the bottom edge 44 may be higher than a bottom of the frustoconical portion 12*a*. For instance, the bottom edge 44 may be as high as a midheight of the frustoconical portion 12*a*.

While one type of bridge 40 is shown, the use of any configuration uniting adjacent receiving cavities 12, including but not limited to cross bridges at an angle, the use of a plurality of bridges, or the like, is contemplated.

Referring to FIG. 4, an embodiment of the container 10 shows where the center reinforcement beams 20 contact the top surface of the base portion 11 when the container 10 is closed. The outline of the center reinforcement beams 20 may match that of the top surface with the presence of the clearances 21 (FIG. 3) following the contour of the receiving cavities 12. In the embodiment of FIG. 4, the center reinforcement beams 20 are shown longitudinally oriented in the Y axis. Two centrally positioned bridges 40A are longitudinally oriented in the X axis, and are between the beams 20 from a plan view. Accordingly, a transverse arrangement of beams 20 and bridges 40A is formed. Other arrangements are considered as well, with the beams 20 being parallel to the bridges 40A and/or parallel to the X axis while the bridges 40A are parallel to the Y axis, etc. When filled containers 10 are stacked one on another, a column is formed by the superposition of transverse arrangements of containers 10.

While different structural formations are shown as used in combination to reinforce the containers 10/10', what is shown is the use of any technique to shape the PET to form stronger reinforcements using ribbing, struts, angles, deformations, thickness variations, and the like.

FIG. 3 shows the combined use, based on the geometry of the container 10, of center reinforcement beams 20 and of struts 22. In one embodiment, the top cover portion 13 may employ either one of the struts 22 and the center reinforcement beams 20. For example, if a longer container 10 is desired (e.g., having 2×24 rows of eggs), the center reinforcement beams 20 may no longer be required and could be replaced by a greater number of struts 22 along the long side of the container 10.

Figure 5:
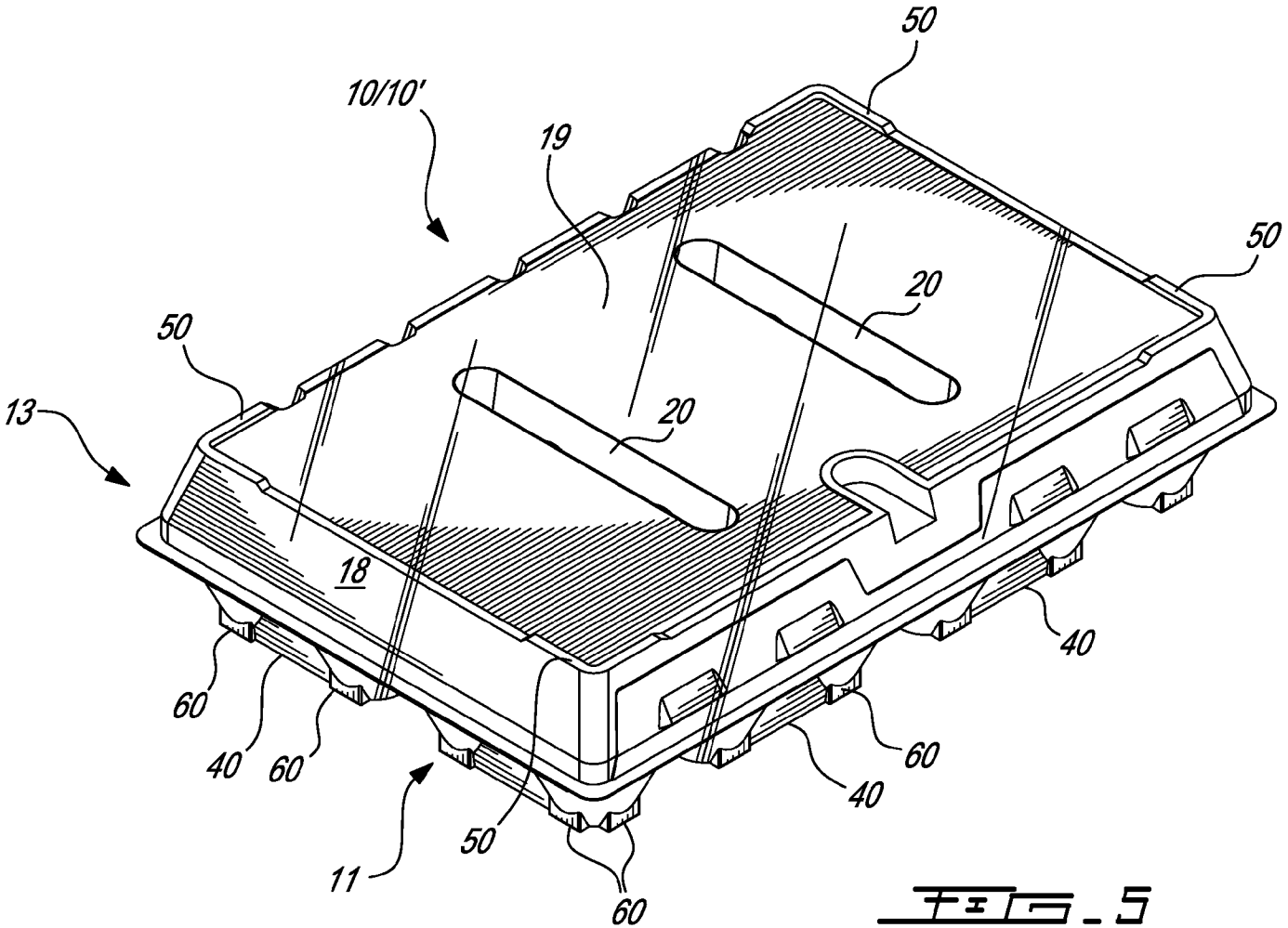
FIG. 5 is a perspective view of the egg container of FIG. 3, as closed.

Referring to FIG. 5, the container 10/10' is shown as closed. The main flat top wall 19 defines a generally flat support surface to support another container 10/10' stacked thereon. Ridges 50 project upwardly from the top wall 19. In the embodiment of FIG. 5, the ridges 50 are at the corners of the container 10/10', and at the intersection between the peripheral walls 18 and the top wall 19. However, the ridges 50 may be positioned at any other suitable location in the top wall 19.

Figure 6:
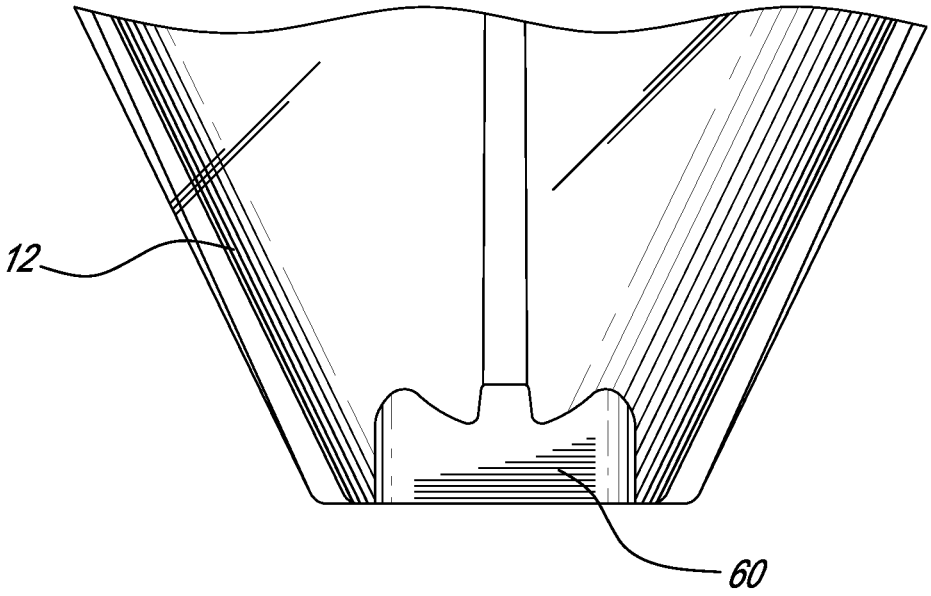
FIG. 6 is an elevation view of an egg-receiving cavity of one of the egg containers of FIGS. 1 and 2, showing an abutment surface.

Referring to FIG. 6, an egg-receiving cavity 12 is shown from an exterior of the container 10/10'. The egg-receiving cavity 12 has abutment surfaces 60 at its bottom. The abutment surface 60 is provided in the container 10 or 10' to define a contact surface for the ridges 50 (FIG. 5) or for a pusher bar of a conveyor (not shown). Considering that typical egg-receiving cavities 12 taper downwardly by their frustoconical geometry, ridges 50 or pusher bars may be guided into going under an container they should be contacting/pushing. Accordingly, the abutment surface 60 is part of a protrusion defined in the receiving cavity 12, and forms a contact plane that is vertical, and therefore perpendicular to a bottom plane of the egg container. The abutment surface is at an angle of 90 degrees or more with respect to the ground.

More than one egg-receiving cavity 12 may be provided with one of the abutment surfaces 60. In the embodiment of FIG. 3, all outwardly facing faces of receiving cavities 12 are provided with such abutment surfaces 60. For instance, the abutment surfaces 60 are parallel to outer edges of the container 10/10'. Accordingly, the cooperation between the ridges 50 and abutment surfaces 60 ensures that the containers 10/10' are in substantial alignment when stacked. The abutment surface 60 and its projection may be provided on two-fold and three-fold egg containers. The abutment surfaces 60 typically have a height of 0.25 inch, sufficient for contact with pusher bars, but an acceptable range is 0.125 inch to 0.5 inch.

It is understood that the preceding is merely a detailed description of some examples and embodiments of the present invention, and that numerous changes to the disclosed embodiments can be made in accordance with the disclosure made herein without departing from the spirit or scope of the invention. It is pointed out that all afore-mentioned structural elements may be used in combination or individually (independently form one another), to strengthen the containers 10 and/or 10'. The preceding description, therefore, is not meant to limit the scope of the invention but to provide sufficient disclosure to one of ordinary skill in the art to practice the invention without any undue burden.

The invention claimed is:

1. A container for receiving frangible items, comprising:

a base having a top surface, a plurality of item-receiving cavities extending downward from the top surface, the top surface including a concave portion to define at least a portion of each of at least two adjacent item-receiving cavities, and at least one recessed bridge extending between the at least two adjacent item-receiving cavities, the recessed bridge being offset with respect to a vertical axis of the at least two item-receiving cavities; and a cover hingedly joined to the base and movable between an open position and a closed position relative to the base, the cover having a top wall and at least one beam extending downward from the top wall and positioned to contact the top surface of the base proximate the at least two item-receiving cavities when the cover is in the closed position, the at least one beam including at least one clearance having an arcuate contour corresponding to at least a portion of a perimeter of each concave portion along the top surface when the cover is in the closed position and at least one beam is in contact with the top surface of the base.

2. The container of claim 1, wherein the at least one beam is positioned to contact the top surface proximate a side of the at least two item-receiving cavities opposite the at least one recessed bridge.

3. The container of claim 1, wherein the at least one beam is positioned to contact the top surface proximate a side of the at least two item-receiving cavities perpendicular to the at least one recessed bridge.

4. The container of claim 1, wherein the at least one recessed bridge comprises two parallel recessed bridges spaced apart and disposed on opposite sides of a latitudinal axis of the container, the at least one beam comprising two parallel beams spaced apart and disposed on opposite sides of the latitudinal axis, wherein the two parallel beams extend parallel to and disposed between the two recessed bridges when the cover is in the closed position.

5. The container of claim 1, wherein the at least one recessed bridge comprises two parallel recessed bridges spaced apart and disposed on opposite sides of a latitudinal axis of the container, the at least one beam comprising two parallel beams spaced apart and disposed on opposite sides of a longitudinal axis of the container, wherein the two parallel beams extend perpendicular to the two recessed bridges when the cover is in the closed position.

6. The container of claim 1, wherein the at least two item-receiving cavities each have a bottom surface defining at least a portion of a reference plane, the at least one recessed bridge having a bottom surface generally coplanar with the reference plane.

7. The container of claim 1, wherein the container is formed from a sheet of polymeric material.

8. A container for receiving frangible items, comprising:

a base having:

a plurality of item-receiving cavities, each cavity defined by a cavity member having a generally frustoconical shape, all outwardly-facing faces of the plurality of item-receiving cavities each having a projection defining an abutment portion, each abutment portion projecting outwardly from an outwardly-facing surface of the cavity member and having a bottom surface defining at least a portion of a reference plane and an outer surface extending upwardly substantially perpendicular to the reference plane; and at least one recessed bridge extending between the abutment portions of at least two adjacent cavities of the plurality of item-receiving cavities, the at least one recessed bridge having an outer surface substantially aligned with the outer surface of the abutment portions.

9. The container of claim 8, the at least one recessed bridge further comprising a bottom surface disposed in the reference plane.

10. The container of claim 8, wherein the plurality of item-receiving cavities comprise a plurality of outer cavities disposed about a periphery of the container, the cavity member of each of the outer cavities having at least one of the abutment portions.

11. The container of claim 8, wherein the outer surface of each abutment portion has a height between about 0.125 inches to 0.5 inches.

12. The container of claim 8, further comprising a cover hingedly joined to the base and movable between an open position and a closed position relative to the base, the cover having a top surface with at least one ridge projecting upwardly therefrom in the closed position, the at least one ridge disposed to engage at least one of the abutment portions of a similarly-configured container when stacked on the cover in a vertical alignment in the closed position.

13. The container of claim 12, wherein the at least one ridge is disposed proximate a periphery of the top surface.

14. The container of claim 8, wherein the container is formed from a sheet of polymeric material.

15. A container for receiving frangible items, comprising:

a base member having:

a top surface; and a plurality of item-receiving cavities, each cavity defined by a cavity member extending downward from the top surface, wherein a first cavity member and a second cavity member are disposed in-line and proximate a periphery of the container with a first recessed bridge extending between the first cavity member and the second cavity member, a third cavity member is disposed inward from the second cavity member with a first recessed shoulder being disposed therebetween, a fourth cavity member is disposed in-line with the third cavity member with a second recessed bridge extending therebetween, a fifth cavity member is disposed outward from the fourth cavity member and in-line with the first and second cavity members, a second recessed shoulder being disposed between the fourth cavity member and the fifth cavity member, and a sixth cavity member is disposed in-line with the first cavity member, the second cavity member and the fifth cavity member, a third recessed bridge being disposed between the fifth cavity member and the sixth cavity member, and wherein the second cavity member and the fifth cavity member are only directly connected by a branch having an upper surface co-planar with the top surface.

16. The container of claim 15, wherein each of the cavity members has a generally frustoconical shape.

17. The container of claim 15, wherein at least two of the cavity members each have a bottom surface defining at least a portion of a reference plane, at least one of the recessed bridges having a bottom surface generally coplanar with the reference plane.

18. The container of claim 15, further comprising a cover hingedly joined to the base and movable between an open position and a closed position.

19. The container of claim 15, wherein the container is formed from a sheet of polymeric material.

20. The container of claim 15, wherein the second cavity member and the fifth cavity member are free of a recessed bridge and recessed shoulder therebetween.

* * * * *